United States Patent [19]

Hardy et al.

[11] 4,333,679

[45] Jun. 8, 1982

[54] VEHICLE TOP TRANSPORTED, SELF CONTAINED CAMPER

[76] Inventors: Raymond D. Hardy, Rte. 3, Box 147B, Robstown, Tex. 78380; William E. Van Steenwyk, 3191 Highway 21A, Festus, Mo. 63028

[21] Appl. No.: 109,868

[22] Filed: Jan. 7, 1980

[51] Int. Cl.[3] ..... B60P 3/32

[52] U.S. Cl. ..... 296/161; 135/4 A

[58] Field of Search ..... 296/216, 159, 161, 165; 182/64; 135/3 A, 4 A

[56] References Cited

U.S. PATENT DOCUMENTS

| | | | |
|---|---|---|---|
| 2,811,725 | 11/1957 | Cence | 296/165 |
| 2,938,525 | 5/1960 | MacKinlay | 135/4 A |
| 3,283,452 | 11/1966 | Hayes | 296/165 |
| 3,289,684 | 12/1966 | Lowe | 296/159 X |
| 3,489,452 | 1/1970 | Plante | 296/161 |

FOREIGN PATENT DOCUMENTS

| | | | |
|---|---|---|---|
| 733117 | 3/1973 | Fed. Rep. of Germany | 296/159 |
| 2624381 | 1/1978 | Fed. Rep. of Germany | 296/159 |

*Primary Examiner*—Robert R. Song

*Attorney, Agent, or Firm*—F. Travers Burgess

[57] ABSTRACT

A camper has a rigid roof structure mountable for travel atop a vehicle, legs pivoted at their upper ends to the roof structure and swingable from horizontal traveling positions along the sides of the roof structure to generally upright positions supporting the roof structure from the ground, the roof structure mounting vertically movable floor structure and collapsible intermediate structure stored in collapsed travel position between said roof and floor structures, and selectively controlled power driven means operatively connecting the floor and roof structures for lowering the floor structure from the roof structure and extending the collapsible intermediate structure to operative condition and raising the floor structure to the roof structure and collapsing the intermediate structure into traveling position.

15 Claims, 7 Drawing Figures

VEHICLE TOP TRANSPORTED, SELF CONTAINED CAMPER

FIELD OF THE INVENTION

The invention relates to traveling campers and consists particularly in a vehicle top-transported, self contained automatically power-deployed camper.

A BRIEF SUMMARY OF THE INVENTION FOLLOWS

All existing vehicle top campers require considerable time and physical effort to set up and require that pipes, poles, stakes, ropes, etc., be taken out of storage, put together and then removed, taken apart and restored. This camper is electrically, hydraulically or pneumatically operated either from the carrying vehicle, or from self contained or campground hookup. The unit may also be operated manually in the event of power failure or no power being available. Other power sources such as a hydraulic of the power steering unit of the vehicle may also be used. It is automatically deployed and restored and no additional parts have to be attached or removed to completely deploy or restore the unit.

After deployment, the structure is latched very quickly to the supporting legs, transferring the weight of the structure to them, making a rigid and substantial unit, requiring no stakes, ropes or other parts except in the case of very high winds.

Among the objects of the invention are the following:

The provision of a camper having a power-driven cable drum mechanism to deploy it and restore it to traveling position and having a dynamic braking device on the cable drum mechanism to assure safe operation during deployment along with means for manual operation.

The provision of a camper requiring no pipes, poles, stakes, ropes or other extraneous attachments requiring assembly, disassembly and storage.

The provision of a camper having a fiberglass and metal insulated foam floor structure capable of having a resistance heating device molded into it.

The provision of a camper having sleeping bunks automatically set up for use as the camper is deployed.

The provision of a camper deployable into a frustopyramidal shape to provide an inside area at bunk level substantially greater than the area of the top.

The provision of a camper in which the carrying vehicle is free for other uses after the camper is deployed.

The provision of a camper in which all fabric coverings are easily replaceable by the use of snap or zipper fasteners to permit conversion to screens or replacement resulting from normal wear and tear.

The provision of a camper of sufficiently light weight and compact size to ensure convenient storage and easy handling.

The provision of a camper having means for latching bottom stiffener rods in the fabric side walls to the legs so as to provide a rigid substantial structure requiring no stakes, ropes or other reinforcing parts under normal conditions and dramatically shortening the time required to set the camper up.

The floor is a semi rigid, fully insulated, waterproof structure that may be electrically heated. The floor also provides stability and rigidity for the entire unit as it rests on the ground.

The sleeping bunks, equipped with mattresses, pillows, blankets, are automatically set up in position as the unit is deployed, providing a rigid sitting, sleeping, or reclining surface. As this occurs, the area of the tent is automatically expanded to provide a 33% greater inside area than when the unit is stored.

Figure 1:
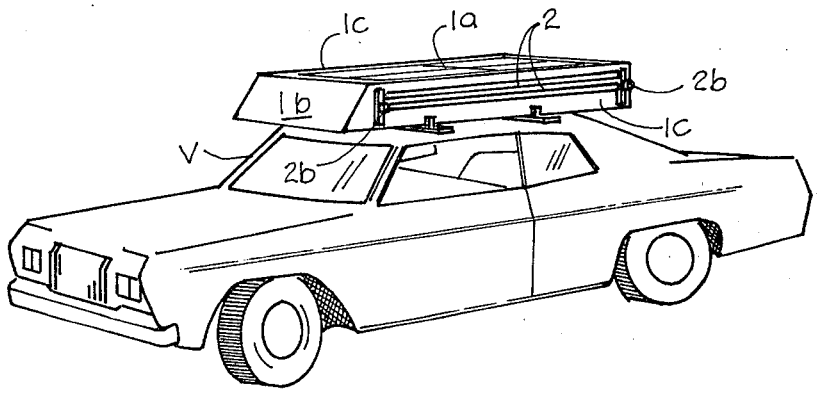
FIG. 1 is a perspective view of a camper incorporating the invention in traveling position on top of an automobile.
Figure 2:
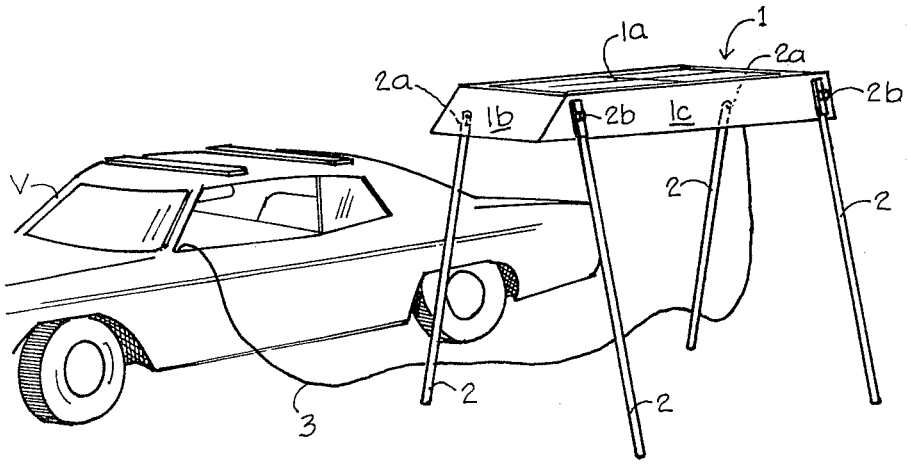
FIG. 2 is a perspective view of the camper illustrated in FIG. 1 and the adjacent automobile showing the initial step in deployment from traveling position to operating position.

The camper comprises a downwardly open, lightweight, rigid, weathertight top structure generally indicated at 1, generally rectangular in plan with a flat top 1*a*, sloping front and rear walls 1*b* and sloping side walls 1*c*, having at each of its four corners a leg 2, each pivoted at 2*a* at its upper end to the top structure side walls 1*c* so as to be swingable downwardly from a horizontal traveling position along the top structure side walls when the top structure 1 is resting as shown in FIG. 1 on top of a motor vehicle V to the transversely inclined ground-engaging positions shown in FIG. 2. Locking nuts 2*b* at the leg pivots are used to lock the legs in inoperative and extended positions. Legs 2 are sufficiently long that when swung to their fully extended positions they provide a free-standing support for top structure 1 at a higher level than the top of the motor vehicle V, permitting the vehicle V to be moved away and used for other purposes. The downwardly open hollow interior of top structure 1 houses a cable drum mechanism 5, driven by an electric motor 4 which may be connected by a suitable cord 3 to a source of electrical energy such as the cigar lighter in the motor vehicle. Preferably the motor 4 includes a dynamic braking device to limit the speed of the motor and the cable drum is also provided with a handcrank 6 to permit its manual operation in the event of power failure. Four cables 8 connected to drum 5 and suspended from pulleys 7 mounted adjacent the corners of the top structure 1 are connected at their ends to corners 15 of floor 11. Floor 11 is a semi-rigid, fully insulated waterproof structure which may be of molded fiberglass material and may have resistance heating devices 12 molded into it to provide radiant heating with electric energy received from a 110 volt A.C. source (not shown). For connecting the camper to electrical power sources, electrical receptacles 13 are mounted on the top structure 1 for the receipt of mating cable plugs.

Figure 3:
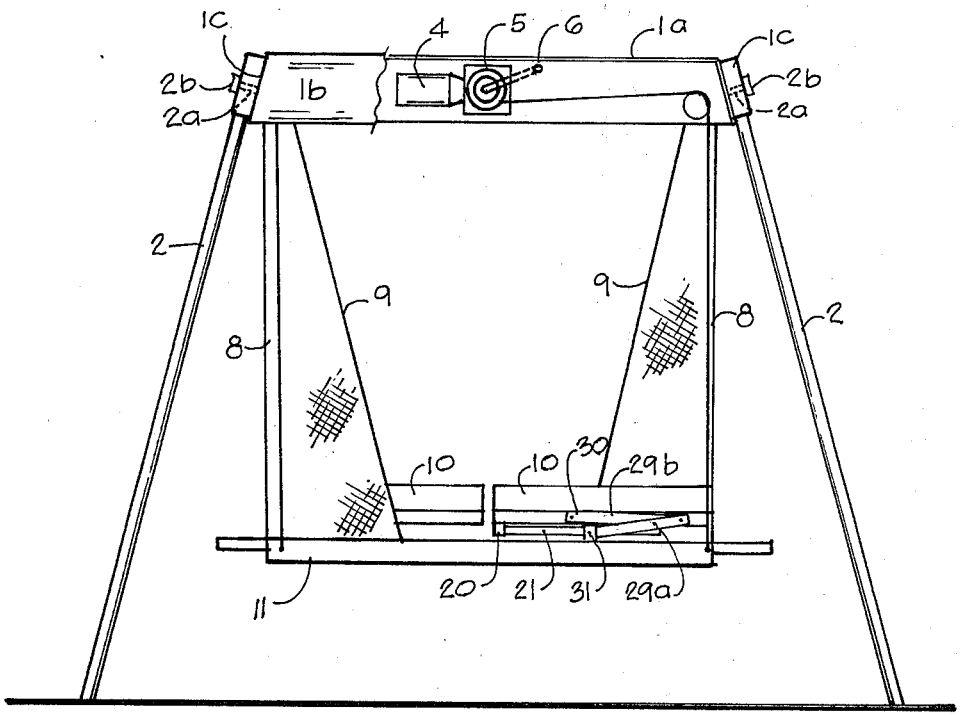
FIG. 3 is an end elevational view partially sectionalized transversely showing the camper at an intermediate step between travel and operating position.

Floor 11 also mounts a pair of bunks 10 normally positioned close to the floor when the floor is in the transport position, i.e., recessed within the hollow interior of top structure 1. Fabric side walls 9 secured at their upper margins to the sides of top structure 1 are secured along their lower margins to bunk 10 such that when floor 11 is fully lowered into camping position (FIG. 5) and side walls 9 become taut, the bunks will assume the position spaced vertically above the floor 11. For automatically moving bunks 10 to a usable height above floor 11 and maintaining the bunks parallel to the floor, a pair of parallel bars 21 are pivoted at their upper ends at 20 to the respective bunks and at their lower ends at 22 to the floor so that as the floor is lowered, as the side walls attached to the outer edges of the bunks become taut, downward movement of the bunks will be stopped a predetermined distance from the top structure and further downward movement of the floor to ground-engaging position will cause the bunks to swing upwardly and outwardly transversely toward the supporting legs from the position shown in FIG. 3 to the position shown in FIG. 5. For locking the bunks in their operating position, a toggle device, consisting of a pair of bars 29*a* and 29*b* pivoted to each other at 29*c* and each pivoted respectively to the floor at 31 and the associated bunk at 30, is provided. An outboard over center locking device consists of an intermediate bar 28 pivoted at its ends to short end bars 28*a* and 28*b*, in a Z configuration with end bar 28*a* pivoted to the ouer edge of the bunk at 26 and the outer lateral extremity of the floor at 27, such that when the bunk reaches its proper height determined by support bars 21, the locking devices 29*a*, 29*b*, 28, 28*a* and 28*b* will be in locked position, as best see in FIG. 5.

Longitudinally extending rods 23, flanged at their ends as at 23*a*, are secured to the lower margins of fabric sidewalls 9 and legs 2 mount keepers 24 at the same level as the bunks such that when the side walls and floor have been fully lowered, the end portions of rods 23 and their flanges 23*a* can be forced into the keepers 24 so as to stabilize the parts in the operating position. At its ends the camper has end flaps 16, the abutting marginal edges 17 of which may be provided with suitable fasteners, such as snaps or zippers (not shown). The side walls may also be formed with window flaps 25. It will also be understood that the side walls and end flaps may be made in whole or in part by mesh material for screening and the top wall may include translucent panels 14 for additional inside lighting.

Figure 7:
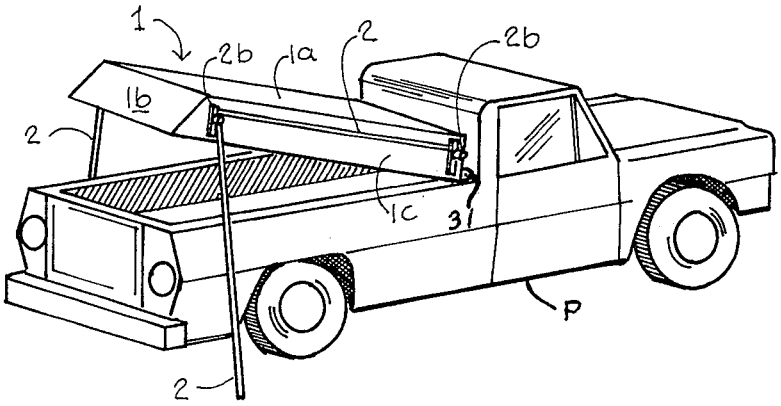
FIG. 7 is a perspective view showing the application of the camper to the bed of a pick-up truck.

As best seen in FIG. 7, the camper may be used as a cargo area cover on a pick-up type vehicle P by being hinged at the front to the vehicle by detachable hinges 31, thus permitting the camper to be raised from the rear to facilitate access to the cargo area in addition to providing a cargo area cover and security for additional camping articles carried in the vehicle area. The camper may be deployed into camping position in the same manner as described previously.

Operating of the camper is as follows:

To deploy the unit, legs 2 attached to the sides of the top 1 are swung down while the camper is still resting on the vehicle. The operator then lifts each corner of the top structure 1 in turn rotates the corresponding leg 2 into the nearly vertical ground-engaging position shown in FIG. 2. The legs are locked into position using locking nuts 1-A. At no time is the operator required to lift more than a small portion of the total weight of the unit (approximately 25%) making it very simple and easy and requiring a minimum of physical effort. When the four legs 2 are in the locked position, the vehicle is free for other use, until it is again used to transport the camper.

The cable winding mechanism 4, 5 is energized, or operated manually, by crank 6 to extend cables 8 and lower floor 11, utilizing the dynamic braking device to limit the speed of floor descent. Since the floor 11 is attached to the lift suspension cables 8 at each of the four corners 15, it would require the failure of two or more cables 8 at the same time before the floor 11 would descend at more than a safe speed.

Figure 4:
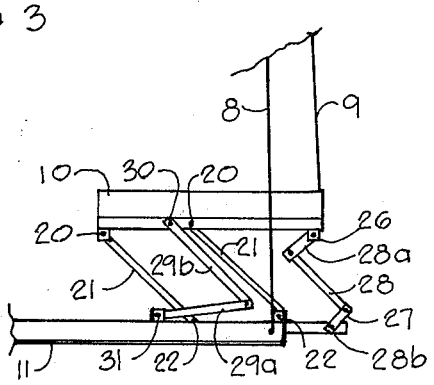
FIG. 4 is a fragmentary end view showing a bunk and the linkage connecting the bunk and camper floor in a lower intermediate position.
Figure 5:
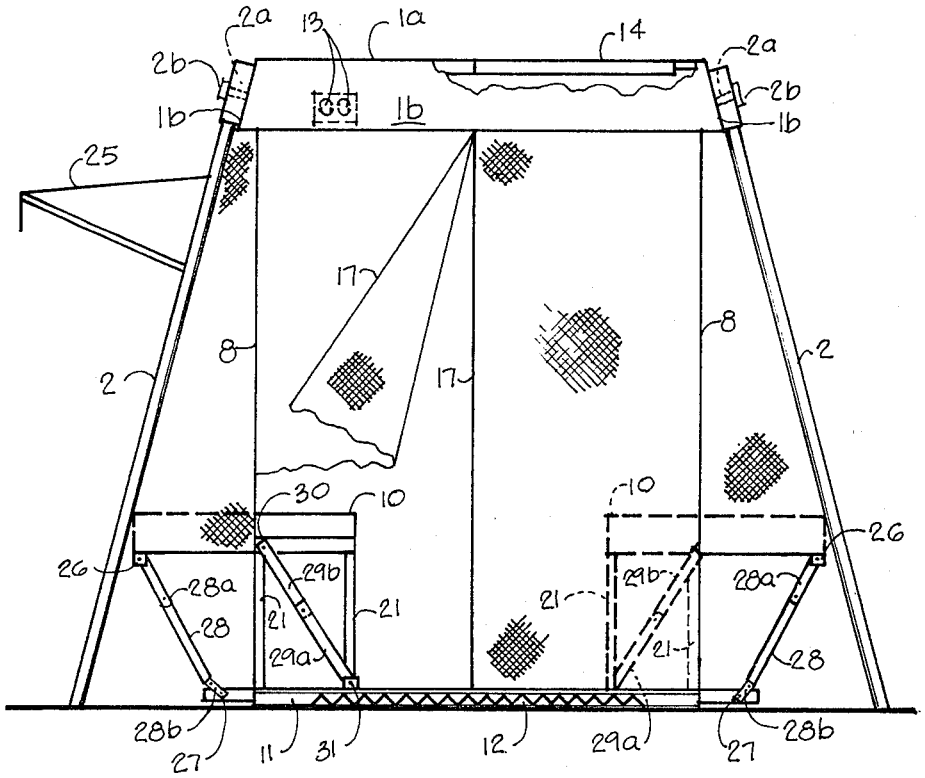
FIG. 5 is an end elevational view of the camper partially sectionalized in fully deployed condition.
Figure 6:
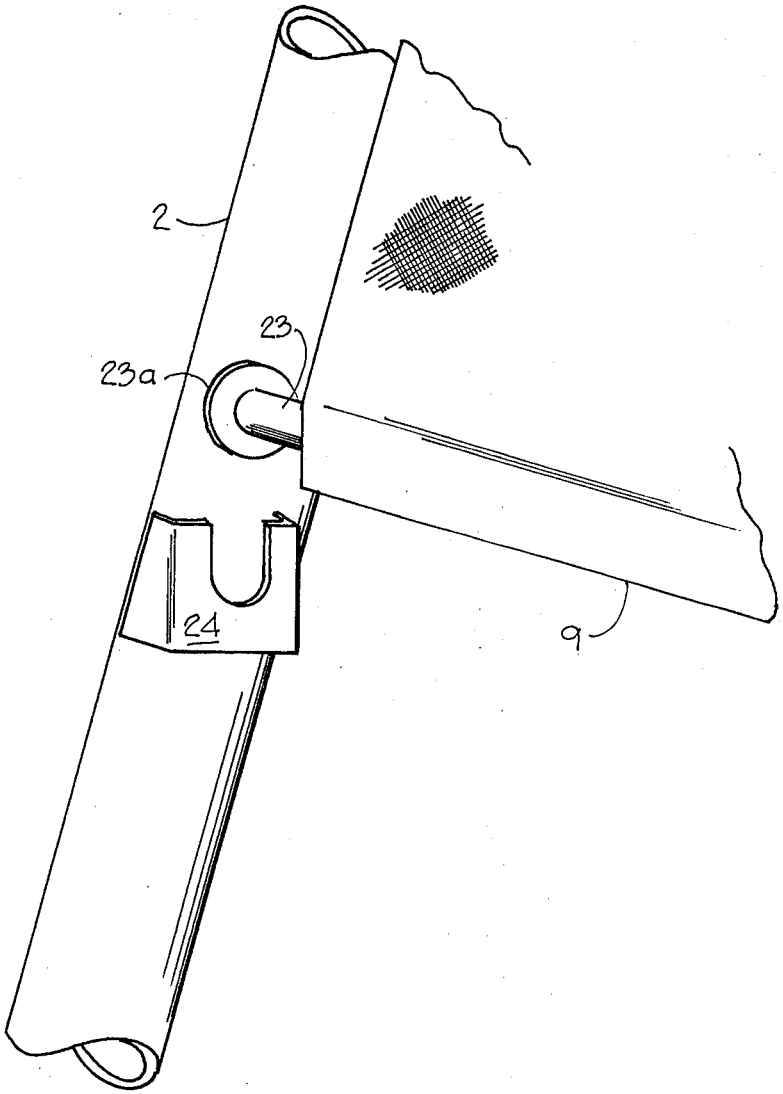
FIG. 6 is an enlarged detailed view showing means for anchoring the flexible side walls of the camper to the corner posts.

As the floor reaches a predetermined position 18 in the development cycle, (FIG. 3) the bunks 10 are automatically set up (FIG. 4) and locked into place (FIG. 5). After the floor reaches the ground position, (FIG. 5) the four corners of the camper are then latched via keepers 24 to the four support legs 2 making a stable camping shelter. Ropes or stakes are not required except in the case of high winds. At this point, the entrance flaps 16 at each end of the camper and the windows 25 on each side can be raised to provide additional ventilation and ease of entry and exit, (FIG. 5) or closed with the use of snaps and/or zippers an abutting edges 17 for privacy or sleep. The end flaps 16 and window flaps 25 may also be fitted with permanent or removable screen sections at the option of the user. Screen sections may also be used on the end flaps to provide additional protected area at either end of the camper. The sides 9 of the camper may also be unsnapped and raised to provide additional covered and protected area. This is the only case where additional material need be added over and above the initial deployment and is optional depending on the needs of the user. In addition, all canvaslike covering is easily replaced because it is installed with snaps and zippers. This feature allows the quick conversion of the canvaslike outer wall 9 to a full screen like outer wall, if so desired.

A simple reversal of the deployment procedure, including some tucking in of the canvaslike 9 covering while powered restoring is taking place by reversing the deployment procedure, is all that is required to make the unit ready for transport to another camp site or the return trip home. (FIG. No. 1). The light weight and compact size of the unit 1 assures easy, convenient storage of it when it is not on the carrying vehicle.

Since many changes and variations of the disclosed embodiment of the invention may be made without departing from the invention concept, it is not intended to limit the invention otherwise than is required by the appended claims.

We claim:

1. A camper comprising a rigid roof structure mountable for travel atop a vehicle, legs pivoted at their upper ends to said roof structure and swingable from horizontal traveling positions along both sides of said roof structure to generally upright positions supporting said roof structure from the ground, said roof structure mounting vertically movable floor structure and collapsible intermediate structure stored in collapsed travel position between said roof and floor structures, and selectively controlled means operatively connecting said floor and roof structures and extending said collapsible intermediate structure to operative condition and raising said floor structure to said roof structure and collapsing said intermediate structure into traveling position, said collapsible intermediate structure having flexible walls and including sleeping bunks connected to said flexible walls and resting on said floor structure when the camper is in traveling position, and parallel maintenance linkage means connecting said bunks to said floor structure whereby to position said bunks above said floor structure when said floor structure is fully lowered.

2. A camper according to claim 1, wherein said roof structure comprises a shallow downwardly open housing.

3. A camper according to claim 2, wherein said intermediate and floor structures are nested within said housing.

4. A camper according to claim 3 wherein said roof structure has a top, side and end walls and said floor structure forms the bottom wall of said housing.

5. A camper according to claim 1 wherein said roof structure includes translucent panels.

6. A camper according to claim 2, wherein said selectively controlled means is power driven and comprises a cable drum mechanism carried by said roof structure and having cable means connected to said floor structure and selectively windable and unwindable on said drum to raise and lower said floor structure.

7. A camper according to claim 6, wherein said cable drum mechanism has a dynamic braking device.

8. A camper according to claim 6, including manual means for operating said cable drum mechanism.

9. A camper according to claim 1, wherein said floor structure is of molded fiberglass and metal insulated foam construction.

10. A camper according to claim 9, wherein said floor structure has a resistance device molded into it to provide heat.

11. A camper according to claim 1, wherein said intermediate structure has flexible walls.

12. A camper according to claim 11 including readily detachable fasteners securing said flexible walls to said structures.

13. A camper according to claim 11, wherein said legs when extended into operating position are outwardly inclined transversely and longitudinally from their pivotal connections to said roof structure whereby to define with said walls, roof structure and floor, a frustopyramid having a base area substantially larger than said roof.

14. A camper according to claim 13, including means latching said intermediate structure to the lower portions of said legs when said intermediate structure is in operating position whereby to secure said legs to each other and provide a rigid support for said roof and intermediate structure.

15. A camper according to claim 1, wherein said legs form the full support of said roof whereby the carrying vehicle is free for other uses when the camper is in operative position.

* * * * *